US011292689B2

(12) United States Patent
Tauscher et al.

(10) Patent No.: US 11,292,689 B2
(45) Date of Patent: Apr. 5, 2022

(54) METHOD AND DEVICE FOR THE OPTIMAL USE OF WINDABLE MATERIAL DURING WINDING UP AND/OR UNWINDING

(71) Applicant: PARTZSCH Spezialdrähte e.K., Rosswein (DE)

(72) Inventors: Rene Tauscher, Döbeln (DE); Remo Nitschmann, Zschaitz-Ottewig (DE); Andreas Zorn, Döbeln (DE)

(73) Assignee: PARTZSCH Spezialdrähte e.K., Rosswein (DE)

( * ) Notice: Subject to any disclaimer, the term of this patent is extended or adjusted under 35 U.S.C. 154(b) by 393 days.

(21) Appl. No.: 16/473,880

(22) PCT Filed: Jun. 28, 2018

(86) PCT No.: PCT/DE2018/000197

§ 371 (c)(1),
(2) Date: Jun. 26, 2019

(87) PCT Pub. No.: WO2019/063031

PCT Pub. Date: Apr. 4, 2019

(65) Prior Publication Data

US 2019/0344991 A1 Nov. 14, 2019

(30) Foreign Application Priority Data

Sep. 29, 2017 (DE) ..... 10 2017 009 156.0

(51) Int. Cl.
*B65H 59/04* (2006.01)
*B65H 23/10* (2006.01)
(Continued)

(52) U.S. Cl.
CPC ..... *B65H 59/04* (2013.01); *B65H 23/105* (2013.01); *B65H 59/10* (2013.01); *B65H 63/086* (2013.01);
(Continued)

(58) Field of Classification Search
None
See application file for complete search history.

(56) References Cited

U.S. PATENT DOCUMENTS 3,853,282 A * 12/1974 Wentworth ..... B65H 23/063 242/419.8
4,807,969 A 2/1989 Shimodaira et al.
(Continued)

FOREIGN PATENT DOCUMENTS

CN 1190361 A 8/1998
CN 201408608 2/2010
(Continued)

*Primary Examiner* — William A. Rivera
(74) *Attorney, Agent, or Firm* — Smartpat PLC

(57) ABSTRACT

A method and a device for optimal use of windable material during winding up onto and/or unwinding from storage drums operates in conjunction with feeding to winding machines. The windable material can be a textile web, a fabric web, a wire or the like. A counterforce necessary for keeping the tension force acting on the windable material constant is maintained until all of the windable material has been fed into subsequent processing. The counterforce may be maintained by a connecting element that is connected to the windable material and to the storage drum, is able to be wound up, and is of lower quality than the windable material. In the device, controllable means generate the counterforce counteracting the tension force until all of the windable material has been drawn into the subsequent processing device.

7 Claims, 2 Drawing Sheets

(51) Int. Cl.
*B65H 59/10* (2006.01)
*B65H 63/08* (2006.01)

(52) U.S. Cl.
CPC ..... *B65H 2301/41525* (2013.01); *B65H 2701/36* (2013.01)

(56) References Cited

U.S. PATENT DOCUMENTS

| | | | | |
|---|---|---|---|---|
| 6,019,200 | A | 2/2000 | Janzen et al. | |
| 6,106,177 | A * | 8/2000 | Siegl | B65H 23/1888 101/228 |
| 6,340,129 | B1 | 1/2002 | Haasen et al. | |
| 10,703,118 | B2 * | 7/2020 | Hayashi | B41J 15/16 |
| 2002/0059013 | A1 * | 5/2002 | Rajala | B65H 20/34 700/122 |
| 2004/0113009 | A1 | 6/2004 | Graeber et al. | |
| 2005/0242224 | A1 * | 11/2005 | Shiraishi | B65H 23/06 242/421.1 |
| 2009/0016797 | A1 * | 1/2009 | Brugue | B65H 23/185 400/613 |
| 2009/0271040 | A1 | 10/2009 | Chen et al. | |
| 2011/0240784 | A1 | 10/2011 | Sakano | |
| 2012/0228362 | A1 | 9/2012 | Schultis et al. | |
| 2012/0267590 | A1 | 10/2012 | Plumettaz et al. | |
| 2014/0204163 | A1 * | 7/2014 | Ortiz | B65H 23/063 347/104 |
| 2015/0175383 | A1 | 6/2015 | Seifert | |
| 2019/0308839 | A1 * | 10/2019 | Schubring | B65H 23/005 |

FOREIGN PATENT DOCUMENTS

| | | | |
|---|---|---|---|
| CN | 102640302 | A | 8/2012 |
| CN | 102687355 | A | 9/2012 |
| DE | 3713815 | A1 | 11/1988 |
| DE | 19524289 | A1 | 1/1997 |
| DE | 19538155 | A1 | 1/1997 |
| DE | 19905860 | A1 | 8/2000 |
| DE | 102005044339 | | 1/2016 |
| DE | 202017006377 | U1 | 1/2018 |
| EP | 1405810 | A1 | 4/2004 |
| EP | 2371751 | A2 | 10/2011 |
| EP | 2891619 | A1 | 7/2015 |
| JP | S617177 | B2 | 3/1986 |
| WO | 2014097675 | A1 | 6/2014 |

* cited by examiner

METHOD AND DEVICE FOR THE OPTIMAL USE OF WINDABLE MATERIAL DURING WINDING UP AND/OR UNWINDING

TECHNICAL FIELD

The disclosure relates to a method and a device for the optimal use of a windable material during winding up onto and/or unwinding from storage drums in conjunction with feeding the windable material to machines for further processing, in particular to winding machines.

BACKGROUND

A windable material can be a textile web, a fabric web, a wire or the like. Such a material may be stored on a storage drum for use in a further processing machine, in particular in a winding machine. A technological space is provided for further processing, in which a preparatory treatment of the winding material is performed after unwinding. These preparatory treatments may consist of a need-based deformation of the windable material for further processing in the further processing machine, in particular in the winding machine. To maintain a constant required tension force while feeding the windable material into the further processing machine, in particular into the winding machine, a counterforce is generated by a braking action of the storage drum.

The prior art, for example according to DE 10 2005 044 339 B4, in this way describes a method for operating a winding machine with which the open-loop or closed-loop controlled winding and/or unwinding of a windable material is carried out. For this purpose, a device for open-loop or closed-loop control is used, with which a variable quantity is monitored. This variable quantity relates to a machine condition which indicates the temperature and/or a wear and/or a mode change and/or a friction change. Depending on the detected change, at least one parameter of the device for open-loop or closed-loop control is then modified. An example of a variable quantity related to a machine condition is a mode change of the winding machine which results in, for example, a change in the tension force. To determine the tension force exerted on the windable material a sensor is used. To carry out the closed-loop control of the winding process, e.g. PID controllers are used. After unwinding of the windable material from the respective storage drum, scrap associated with the storage drum remains as waste or secondary raw material. The remaining length of the windable material per storage drum corresponds to the distance between the storage drum and the winding machine.

A method for operating a workstation in a textile machine for making cross wound reels is further known in the field of textile machinery according to DE 199 05 860 A1. In this method, a thread tension force sensor is used to monitor the thread tension force of a thread running from a feeding reel to a receiving reel. The thread tension force is controlled by means of a thread tensioner depending on the determined sensor values. Using a workstation computer, the contact pressure of the thread-braking device of the thread tensioner acting on the thread is predetermined in accordance with the thread tension determined by the thread tensile force sensor. As a result, a substantially constant thread tension of the moving thread is set to ensure a uniform winding of the thread on the receiving reel. After cutting off the respective threads, the respective scraps also remain between the feeding reel and the receiving reel. From an economic point of view, this proves to be particularly disadvantageous in the further processing of high-quality fabric or textile webs.

Known also from EP 2 891 619 A1 is a winding device for winding at least one windable material onto at least one replaceable sleeve. The subject device has a mass detection unit with which a mass characteristic value of the windable material is determined at predetermined times. On the basis of these values, the tension acting on the winding material is then controlled. With this control, accurate monitoring of a winding operation is advantageously made possible and thereby the properties of the winding device can be improved. Also, this winding device has an economic disadvantage in that scraps of the windable material remain after completion of the winding process, in particular of high-quality windable materials.

According to DE 195 24 289 C2, a device for braking electrically conductive strips has also been disclosed, which has a magnetic field generating device for braking electrically conductive strips. In this case, the strip to be braked is arranged in front of the processing station and is further processed under tension. With the magnetic field generating device, an alternating magnetic field is generated which induces eddy currents in the strip and thereby exerts a force which is directed against the conveying direction thereof. By means of this device, the strips are held under constant tension during the feed to a further processing station. The proposed solution allows non-contact braking of a strip regardless of its movement. Due to the contactless braking process, damage to the strip surface is avoided. However, even with the use of this device, no measures to prevent the occurrence of scraps, in particular of high-quality windable material after completion of the respective unwinding process are provided.

SUMMARY

An object of the disclosure is to provide a method and an apparatus for performing the method, with which it is possible to complete feed a windable material from storage drums to technological further processing.

The object is achieved by the method and the device as claimed. With the disclosed method a required constant tension force is maintained until a windable material has been completely fed into a subsequent further processing device, such as, for example, a winding machine. This maintaining of a constant tension force is achieved in that the counterforce acting on the windable material is generated even after the completed unwinding of the supply roll. The method proves to be advantageous if the counterforce continues to be generated even after the unwinding of the windable material by utilizing the counterforce generated by the braking devices on the supply roll. The bridging of the gap between the supply roll and the subsequent further processing device is achieved by connecting the windable material with a material that can be wound and that is inferior in relation to the windable material. For this purpose, one end of the connecting element is connected to the storage drum and the opposite end to an end of the windable material. Preferably, for the automated performance of the method, after the completion of the unwinding of the windable material from the supply roll, the counterforce is generated by a braking device arranged in front of the entry location of the subsequent further processing device. Before the controlled induced braking by the braking device, a detachment of the end of the windable material from the supply roll takes place. For a timely beneficial performance of the controlled braking process, a mark is applied to the windable material and sensed during the unwinding process and signaled to a subsequent controller.

The method is preferably carried out by controllable means which generate a counterforce to the tension force with which the counterforce to the tension force is maintained until the complete feed of the windable material into the subsequent processing device. For an economically effective design of the solution a windable connecting element having a maximum length corresponding to the distance between the storage drum and the entry point into the winding machine is, with its first end, releasably connected to the storage drum and, with its second end, connected to the beginning of the windable material. In order to advantageously avoid damage to the surface of the windable material, the braking device is formed such that it comprises at least two pressure assemblies which roll on the windable material and generate a braking force which counteracts the tension force. In the processing of electrically conductive windable material with a pressure-sensitive surface (insulation), the braking device is technically effectively formed by at least two magnetic field generating members for generating a braking force that counteracts the tension force. Advantageous automation of method is achievable with little effort by connecting to the storage drum that end of the windable material which is to be connected to the storage drum by means of a controllable connection module that is fixed to the storage drum, by subordinating to the connection module a controller which controls a detachment of the winding end at the end of the unwinding process, and by connecting the controller to a sensor for detecting a marking mounted on the windable material and to the braking device. In order to reduce the technical complexity, the connection module connected to the storage drum is preferably configured such that it has a releasing mechanism which automatically separates the windable material at the end of the unwinding process from the storage drum.

Hereafter, the solution will be explained in more detail using an exemplary embodiment.

DETAILED DESCRIPTION

Figure 1:
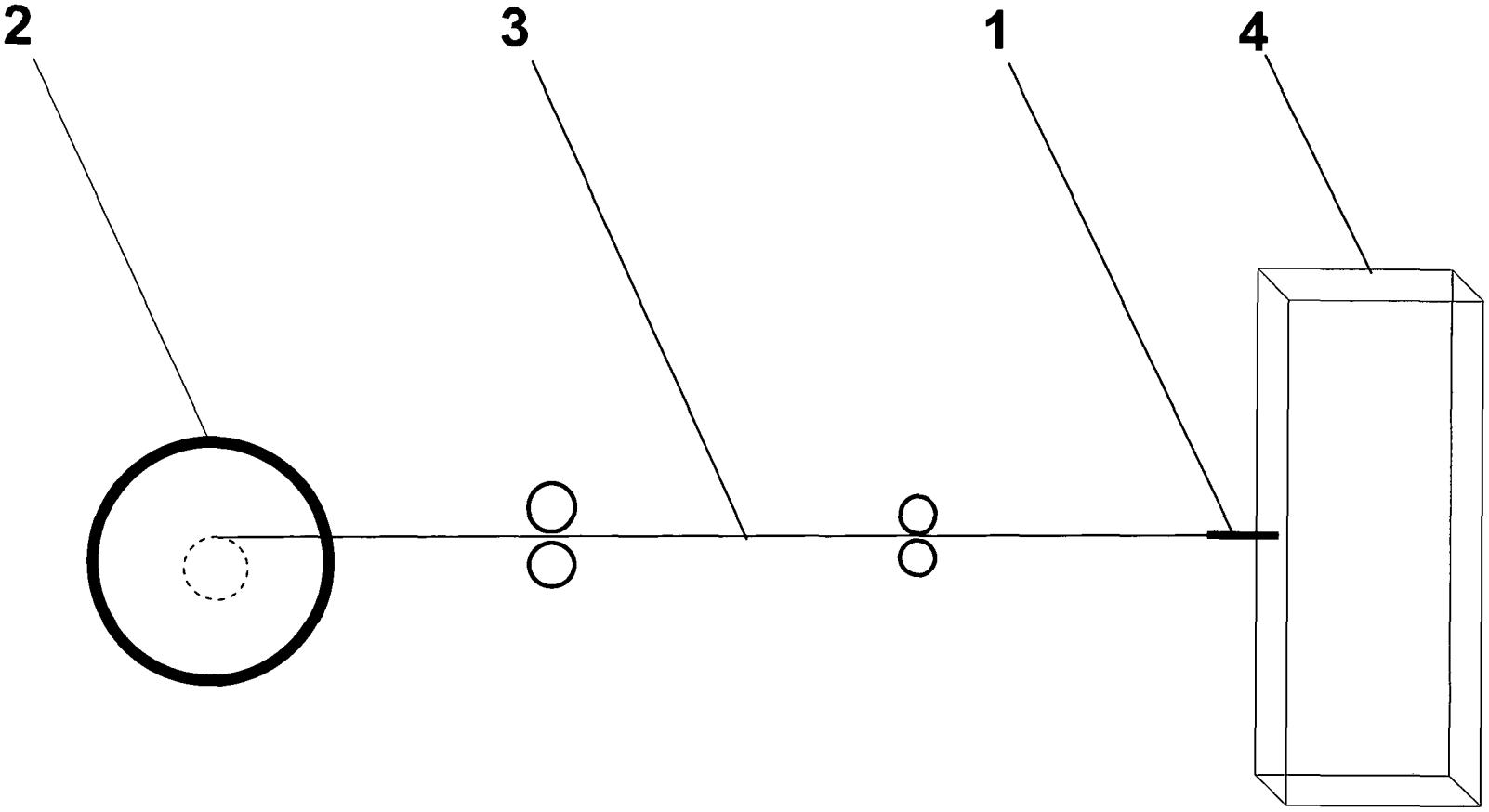
FIG. 1 shows a schematic arrangement of the windable material connected to the connecting material in the unwinding of the storage drum.

The schematic arrangement shown in FIG. 1 shows the storage drum 2 with windable material 1 (e.g. copper wire) already unwound from it. The transport path provided between the storage drum 2 and the following winding machine 4 serves for the technological preparation of the windable material 1 for further processing by the winding machine 4. This preparation may, for example, consist of the required stretching of the windable material 1 for the feed into the winding machine 4. The required stabilization of the tension force for unwinding, processing, and transport to the winding machine 4 here is effected by the counterforce applied by the storage drum 2. After unwinding, this required counterforce is no longer available. The remaining stretched windable material 1 between the storage drum 2 and the winding machine 4 is separated after the unwinding of the storage drum 2 and cut at the entry point to the winding machine 4. This part of the windable material 1 then accumulates as secondary raw material. Depending on the planned production line, the length of this transport section is between 5-8 m. If the winding material 1 is made of copper wire, the weight of the technologically unused material per storage drum 2 is about 1 kg up to 10 kg for average cross-sections used. The aim of the present solution is to fully integrate this part of the windable material 1 in the technological process sequence and thus make it usable. For this purpose, a compared to the windable material 1 inferior connecting material 3 is connected to one end of the windable material 1 and wound right at the front during the winding onto the storage drum 2. After the completion of the unwinding, this connection material 3 in conjunction with the storage drum 2 takes over the generation of the counterforce for maintaining a constant tension force. By the predetermined length of the connection material 3, at the same time, the target of how far the windable material 1 is to be fed into the winding machine 4 is being set.

Figure 2:
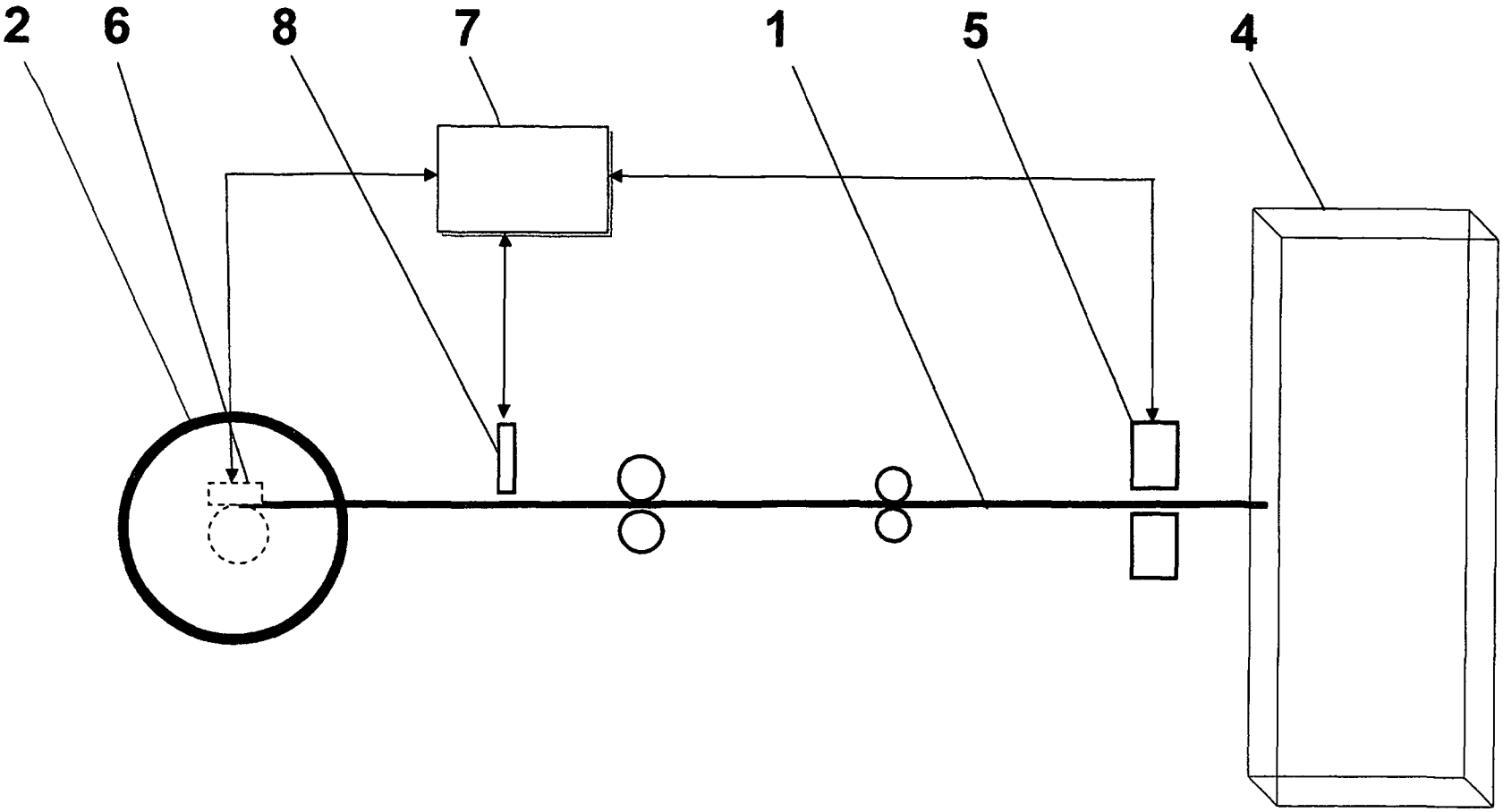
FIG. 2 shows a schematic arrangement of the modules involved in the controlled unwinding of the windable material from the storage drum by a braking device.

The schematic representation of FIG. 2 shows the arrangement of the required modules for a controlled unwinding of the storage drum 2. In this arrangement, the braking device 5 takes over the generation of the counterforce after the completed unwinding. This braking device 5 is arranged directly at the entry point of the winding machine 4. This arrangement is controlled by the controller 7. In this case, the controller 7 may be a part of the already existing central control on the winding machine 4 or the control can be taken over by this central control. Rollers can be used as a braking device 5, which rest on the surface of the windable material 1 and run with the winding material 1. Depending on the shape of the surfaces of the windable material the required pressure of the rollers for the generation of the braking force can be distributed to a plurality of braking devices arranged along the transport path. When using windable material 1 with a pressure-sensitive surface (insulation), there may be the risk of damage to the surface material by using rollers. In order to avoid this damage, the braking device 5 can be formed in the case of winding material 1 made of electrically conductive material, for example, as a magnetic field generating device. When winding or feeding a multi-core windable material 1, the braking process for all wires of the winding material 1 is carried out simultaneously. The detachable attachment of the windable material 1 to the storage drum 2 is provided by the connection module 6. By the connection module 6, not shown here, the windable material 1 is held by the support of the winding on the connection module 6. The winding itself compresses a spring element and holds by forceps action the end of the windable material 1 firmly in position until the unwinding or the release of the spring tension. Likewise, the holding and releasing operation can be controlled by an electromechanical module by the controller 7. On the surface of the windable material 1 a marking is applied, which is detected by a sensor 8 during transport and signals the detection to the controller 7. The signal indicates the reaching of a predetermined position for a remaining length of the windable material 1. The signal is evaluated by the controller 7 and triggers the braking operation of the braking device 5. At the time of complete unwinding and detachment of the windable material 1 from the storage drum 2 the controlled braking device 5 takes over the generation of the required counterforce. Until reaching a predetermined position the feed of the windable material 1 is controlled by the controller 7 which is signal-technologically connected to the winding machine 4.

REFERENCE NUMERALS

1 windable material
2 storage drum

3 connecting element
4 winding machine
5 braking device
6 connection module
7 controller
8 sensor

The invention claimed is:

1. A method for optimal technological integration of a windable material during winding and unwinding, wherein a counterforce required for stabilization of a tension force acting on the windable material is maintained until the windable material has been completely fed to subsequent further processing, wherein the counterforce is generated by a braking device arranged at an entry of a winding machine after the windable material has been completely unwound and an end of the windable material has subsequently detached from a storage drum, wherein a braking operation effected by the braking device is triggered by sensory detection of a marking applied to the windable material, and wherein a timing of the braking operation is controlled by a subordinated controller.

2. The method according to claim 1, wherein the counterforce is maintained by a connecting element which is connected to the windable material and to a storage drum, is windable, and is comparatively inferior to the windable material, and wherein one end of the connecting element is connected to the storage drum and an opposite end of the connecting element is connected to one end of the windable material.

3. A device for optimal technological integration of a windable material during winding and unwinding, comprising:

a controllable counterforce generator which generates a counterforce counteracting a tension force, by means of which the counterforce counteracting the tension force is maintained until the windable material has been completely fed into a subsequent processing device, wherein a braking device comprises at least two magnetic field generators for generating a braking force counteracting the tension force in an electrically conductive windable material.

4. The device according to claim 3, wherein a windable connecting element having a maximum length corresponding to a distance between a storage drum and an entry point into a winding machine has a first end detachably connected to the storage drum and a second end connected to a beginning of the windable material.

5. The device according to claim 3, wherein a braking device comprises at least two pressure assemblies which roll on the windable material and generate a braking force counteracting the tension force.

6. A device for optimal technological integration of a windable material during winding and unwinding, comprising:

a controllable counterforce generator which generates a counterforce counteracting a tension force, by means of which the counterforce counteracting the tension force is maintained until the windable material has been completely fed into a subsequent processing device, wherein an end of the windable material to be connected to a storage drum is connected to the storage drum by a controllable connection module attached to the storage drum, wherein the connection module is controlled by a controller which controls a release of the end of the windable material upon completion of an unwinding process, and wherein the controller is connected to a sensor serving to detect a marking on the windable material and to a braking device.

7. The device according to claim 6, wherein the connection module attached to the storage drum includes a release mechanism which automatically separates the windable material from the storage drum upon completion of the unwinding process.

* * * * *